United States Patent [19]

Mitchell

[11] 4,167,783

[45] Sep. 11, 1979

[54] PORTABLE LIGHTING SYSTEM HAVING A FOOT OPERATED DIMMER

[76] Inventor: William P. Mitchell, P.O. Box 42, Maryville, Tenn. 37801

[21] Appl. No.: 829,187

[22] Filed: Aug. 30, 1977

[51] Int. Cl.[2] ..... F21J 1/00

[52] U.S. Cl. ..... 362/236; 362/285; 362/287; 362/295; 362/317; 362/411; 362/413; 362/414; 362/431

[58] Field of Search ..... 362/236–238, 362/295, 285, 287, 317, 411, 413, 414, 431

[56] References Cited

U.S. PATENT DOCUMENTS 1,941,503 1/1934 Villiers ..... 362/233

*Primary Examiner*—Stephen J. Lechert, Jr.
*Attorney, Agent, or Firm*—Pitts & Kesterson

[57] ABSTRACT

A portable lighting system which includes a stand having an adjustable effective length which positions lights carried on a frame at a predetermined vertical position with respect to a supporting surface. The frame is releasably secured to the stand and can readily be set up and dismantled for transport in a compact space. Lights carried by the frame are connected to a foot operated control box which includes switches actuated to energize preselected lights or groups of lights. The energized lights or preselected energized lights can be intensity modulated with a foot operated dimmer while leaving the operator's hands free to play a musical instrument.

15 Claims, 5 Drawing Figures

PORTABLE LIGHTING SYSTEM HAVING A FOOT OPERATED DIMMER

This invention relates to portable lighting system having a foot operated dimmer for varying the intensity of preselected energized lights.

Lighting systems for stages are well known and commonly include a console which is provided with controls adapted for energizing and varying the intensity of preselected lights. The lights can be carried by adjustable frames which serve to direct the lights to a chosen section of a stage. For example, U.S. Pat. No. 2,659,038 discloses a lighting system for automatically controling the illumination of one or a plurality of stages or sets. This prior art system includes a control panel from which pin type switch buttons are connected to an energy supply over cables and selectively energize lamps.

Foot operated rheostats are also well known, and one such rheostat is illustrated in U.S. Pat. No. 3,845,446. This device is in the form of a flat casing which carries a resistance element that is interconnected to a foot pedal rotatably mounted on the casing. As the foot pedal is actuated an arm is rotated for sweeping the conductive element of resistive elements and varying the resistance. A further prior art foot pedal device is illustrated in U.S. Pat. No. 2,534,939 which disclosed a rheostat interconnected to a foot pedal by a rack and pinion arrangement.

While certain of the prior art systems are well adapted for use as fixtures in permanently installed lighting systems, the systems are not believed to be well suited for use as portable units which can be readily set up and dismantled by a layman not having particular skills as an electrician. Accordingly, the system of the present invention includes at least one lighting tree having a stand, and frame which is releasably mounted on the stand. The frame carries a plurality of lights which can be adjusted for directing light in a preselected direction. The lights are selectively energized, and may be arranged in groups having one or more lights of various colors which are energized by switches. Certain of the lights are intensity modulated by a foot operated dimmer for creating desired stage light-effects. The system including the control circuitry can readily be set up and dismantled by a single operator. Moreover, the lights can be selectively energized and intensity modulated by the foot of an operator leaving the operator's hands free to play a musical instrument, for example. To facilitate carrying the system after it is dismantled, the various competents are manufactured from light weight materials, preferably. Moreover, the cost of manufacturing the system is relatively inexpensive making the system particularly desirable for single musicians on short term engagements at night clubs or the like.

Other objects and advantages of the present invention will become apparent upon reading the following detailed specification together with the drawings wherein.

Figure 1:
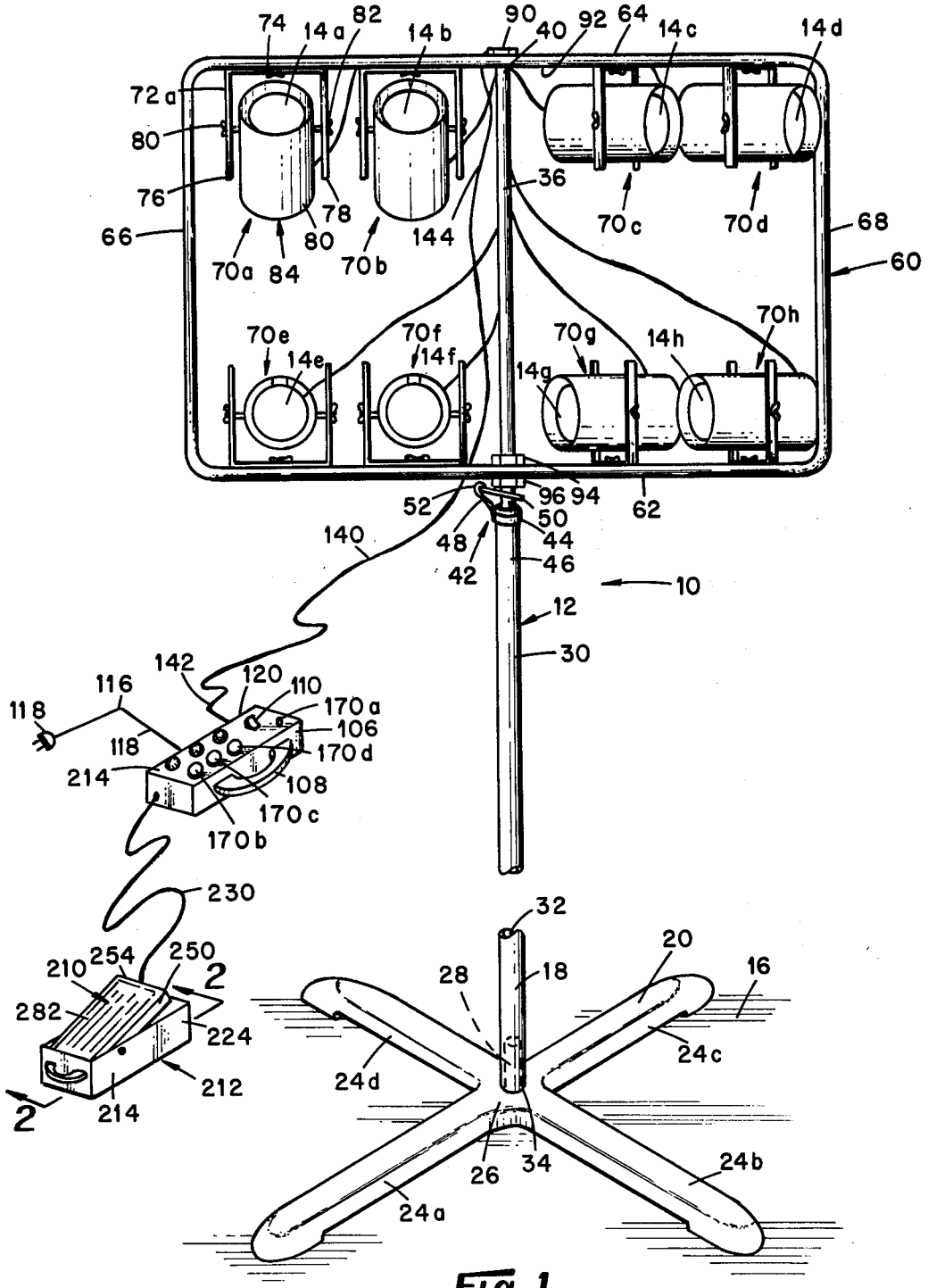
FIG. 1 is a perspective view of a lighting system constructed in accordance with various features of the invention.

Referring now to the drawings, a lighting system embodying various features of the present invention is illustrated generally at 10 in FIG. 1. The illustrated lighting system is adapted for use as in stage lighting and finds particular application as a portable unit which can be operated by a single musician as he simultaneously plays before an audience.

The system 10 includes a light tree 12 which supports a plurality of lights 14 a–h which can be adjusted vertically with respect to a supporting surface 16. More specifically, the tree 12 includes a stand 18 having a base 20 which engages the supporting surface 16 and includes four feet portions 24 a-d which extend outwardly at substantially equal angles from a central section 26. The central section of the stand carries a substantially upright stud 28 which is cylindrical and secured as by welding, or with a bolt extending through the base to the central section 26.

An elongated tubular member 30 fabricated from a suitable rigid material such as steel, aluminum, plastic or the like is releasably secured to the base 20 and maintained in an upright position. In this connection the lower end portion of the tubular member bore 32 telescopically receives the stud 28 and is advanced over the stud until the end edge 34 of the member 30 rests against the central section 26 of the base 20.

A further elongated member 36 is telescopically received within the bore 32 of the tubular member 30 and is substantially axially aligned with respect to the axis of the stud 28 and member 30. The combined effective length of the members 30 and 36 is adjustable by sliding the member 36 within the bore 32. More specifically, if it is desired to increase the combined effective length of the members 36 and 30, the member 36 is partially withdrawn from the bore 32. Contrawise, if it is desired to decrease the combined effective length of the members 30 and 36, the member 36 is advanced into the bore 32 of member 30.

Means are provided for fixing the relative position of the members 30 and 36 such that end 40 of member 36 and the lights are disposed at a preselected position with respect to the supporting surface 16. In this connection a suitable stop 42 of conventional design is provided which in the illustrated embodiment comprises a collar 44 fixedly secured as by a bolt or screw (not shown) to the end portion 46 of the member 30. This collar supports an arm 48 which projects outwardly from the axis of the member 30 and carries tab 50 at its end portion 52. This tab 50 is pivotally mounted on the outboard end portion 52 of the arm and defines an opening (not shown) which slidably receives the member 36 therethrough. As the member 36 slides downwardly into the member 30, the tab 50 frictionally engages the surface of member 36 and prevents further downward movement of the member 36. If it is desired to extend the member 36, i.e., withdraw the member from the bore 32, the tab 50 is tilted upwardly such that the member 36 can slide freely within the bore 32 of member 30. Similarly, if it is desired to decrease the combined effective length of members 30 and 36 by inserting member 36 into bore 32 of rod 30, the tab 50 is rotated upwardly until the member 36 can freely slide within the tab opening and upon positioning the member 36 at a desired location the tab 50 is rotated downwardly until it frictionally engages the member 36 and holds the member 36, preventing further sliding motion of this member.

It will be recognized that alternate means may be provided for fixing the relative position of the members 30 and 36. For example, a suitable set screw (not shown) may be threadably received in a bore defined in the end portion 46 of the upright member 30 such that upon advancing the screw into the bore, one end of the screw engages the member 36 slidably received within the bore 32, for purposes of securing the member 36 in a fixed vertical position with respect to the member 30.

The lights of the system are carried by a frame 60 which in the illustrated embodiment is substantially rectangular in outline and includes a pair of substantially horizontally disposed members 62 and 64 which are joined at their opposite ends by a pair of substantially vertically disposed members 66 and 68. The substantially horizontally disposed members 62 and 64 may be integrally formed at their opposite ends with the substantially vertical members 66 and 68. Preferably the frame members 62–68 are fabricated from a lightweight and substantially rigid material such as sheet metal tubing, for example. The frame 60 is preferably fabricated from a lightweight material to facilitate carrying the system inasmuch as it is particularly adapted for use as a portable unit.

The orientation of the lights 14 a–h which are carried by the frame 60 can be adjusted in vertical and horizontal planes for illuminating predetermined areas of a stage, for example. In this connection each of the lights 14 a–h are mounted in brackets 70 a–h, respectively which are secured to the frame 60. More particularly, the brackets 70 a–d are secured to the cross or horizontally disposed frame member 64 and the brackets 70 e–h are secured to the horizontally disposed frame member 62. (See FIG. 1) Each of the brackets 70 a–h are substantially identical and for this reason the bracket **70*a* only will be described in detail. The bracket 70*a* is rotatably mounted on the member 64 for purposes of rotating the light 14*a* about a vertical axis. The bracket 70*a* includes a clevis 72*a* which is rotatably secured to the member 64 by a bolt and companion wing nut 74. Arms 76 and 78 of the clevis are provided with registering bores which receive bolts 80 and 82 and are secured at their respective outboard ends to a substantially circular housing 84 which carries the light 14*a*. The light 14*a* is mounted in the housing 84 by a conventional socket (not shown) which is carried within the portion 86 of the housing as by a bracket or the like secured to the housing and substantially axially aligned with the housing axis 84. This socket threadably receives the base portion of the lights 14 therein. The housing 84 is rotatable within the clevis 72*a* such that the light 14*a* can be rotated within a vertical plane. The housing 84** further serves to shield and direct the illumination to a preselected location.

When the system is dismanteled for storage or transport the lights and their respective housings can be secured to assist in preventing inadvertent movement of the lights which might result in damage. It will be recognized that by tightening the wing nut 74 movement of the light in a horizontal plane is restricted. Wing nuts 80 and 82 can be tightened to restrict movement in a vertical plane. Preferably, the housings are rotated until their axes are substantially parallel with the frame members 66 and 68 to assist in shielding the lights during transport.

To facilitate demounting the system 10 for purposes of packing, for example, after completion of a musical engagement the frame 60 is releasably secured to the upright member 36. To this end, a bolt 90 is received in a bore provided in the cross member 64 at its substantial mid portion. This bolt 90 is proportioned such that one end portion of its shaft extends through the cross member. The projecting portion of the bolt shaft is received within a bore provided within the end portion 40 of the member 36. Preferably, the member 36 is tabular, however, as necessary or desired the member 36 may comprise a solid rod having a bore opening on its end surface and proportioned for receiving the shaft of bolt 90 therein.

Upon positioning the bolt 90 within the bore of member 36, the underside 92 of member 64 is supportably engaged by the end portion 40 of the member 36. The cross member 62 is releaseably secured to the member 36 by a spring clip 94 of conventional design. This clip 94 is U-shaped and secured to the cross member 62 by the bolt 96 and includes two juxtaposed prongs which expand apart for receiving the member 36 therebetween. The clip prongs then contract to engage the opposite sides of the member 36 and assist in joining member 36 and cross member 62.

When it is desired to dismantle the system, cross member 62 can be moved outwardly from the member 36 until clip 94 releases the member 36. The frame 60 can then be lifted upwardly sliding the bolt 90 from the bore of member 36. When the bolt 90 is removed from this bore, the frame 60 and its associated wiring can then be stored independently of the members 30 and 36.

In certain stage lighting applications it is desirable for multicolored lights to be used. In this connection, the lights 14 a–h can include various colors or lenses of various colors may be provided over the end of the housings 84 from which light is emited. In one embodiment, the lights are arranged in groups having different colors. For example, in one embodiment lights 14 a–b are white or spot lights, lights 14 c–d are red, lights e–f are amber and lights g–h are blue. By arranging the lights in multicolored groups different stage lighting effects can be achieved by energizing preselected groups of the lights. Moreover, inasmuch as the individual lights 14 a–h can be independently rotated in a vertical and horizontal plane, various sections of the stage can be illuminated as necessary or desired. Further, the intensity of the individual lights or groups of lights can be varied as necessary or desired as will be further described hereinafter.

Figure 3:
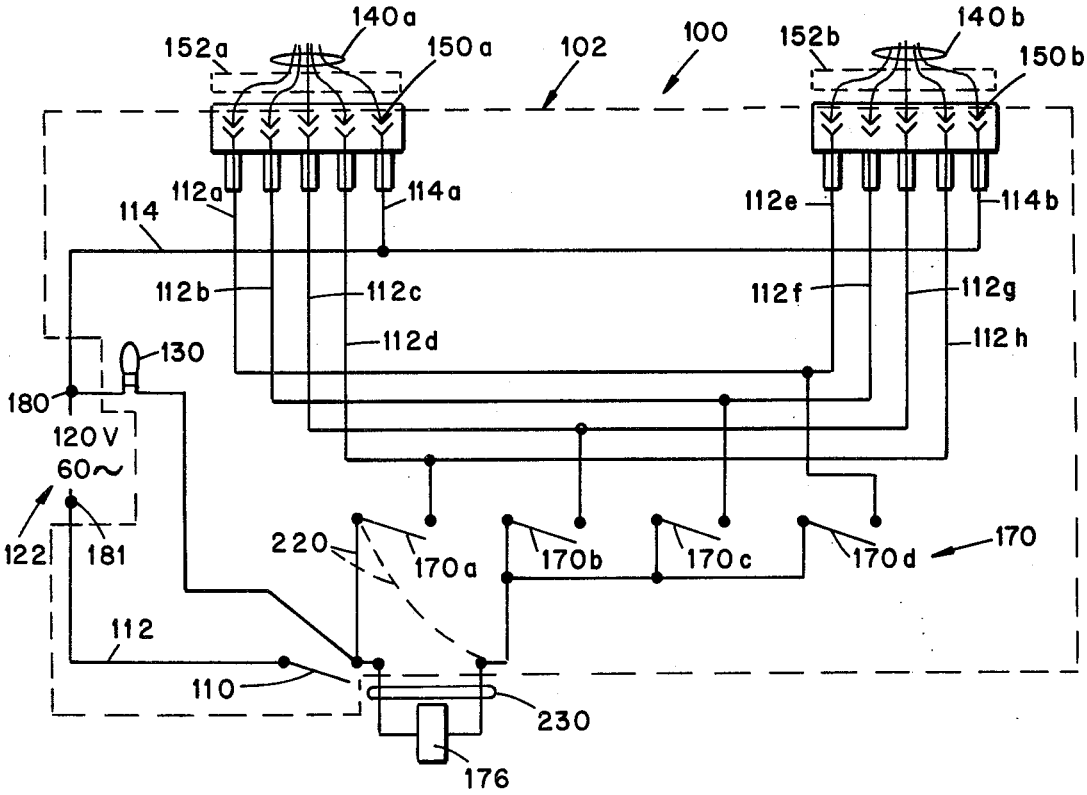
FIG. 3 is a schematic diagram of a portion of the control circuitry of the present system.

Control circuitry generally indicated at 100 is provided for selectively energizing and controlling the intensity of the lights 14 and/or preselected groups of the lights. In the illustrated embodiment a portion 102 of the circuitry 100 is carried in a control box 104 having a substantially rectangular outline and having wall panels which are fabricated from a suitable rigid material such as sheet metal. As shown in FIG. 1, the front panel 106 is provided with a handle 108 which is secured by screws, bolts, or the like at its opposite ends to the panel at spaced locations. As shown in FIGS. 1 and 3, the portion 102 of the circuitry 100 carried by the control box 104, includes a master on-off switch 110 which selectively energizes the system by applying power across leads 112 and 114, which are connected as through the cord 116 and plug 118 to a conventional power supply such as a wall outlet. This switch 110 is carried by the top panel 214 of the control box 104 and is operable by the foot of an operator. A suitable indicator lamp 130 is connected in series with the switch 110 and source applied across leads 112 and 114 as shown in FIG. 3 to indicate when the switch 110 is closed and power is allowed to pass through it to the remaining circuitry. As necessary or desired, this lamp 130 may be mounted on one of the panels of the control box 106.

In the preferred embodiment, the control box 104 is connected to a supply by connecting end portion 118 of the cord 116 with leads 112 and 114. To this end, the rear panel 120 of the box 104 is provided with a socket 122 illustrated diagrammatically in FIG. 3 which receives a mating plug (not shown) which is connected at end 118 of the cord 116.

Power is supplied to the lights 14 a–h through the leads 112 and 114 and the cable 140 which is connected to the control box at its end 142 which is provided with a suitable plug of conventional design. More specifically, cable 140 comprises a bundle of wire leads which diverge at end 144 of the cable 140 and are connected in a conventional manner to each of the lights 14 a–h through respective sockets.

To facilitate quick connection and disconnection of the lights and the control box 104, for purposes of a quick set-up at a performance site for example, connectors 150 a–b of conventional design are provided. In the depicted embodiment, the connectors or jacks 150 a and b are mounted on the control box 104 and receive a conventional plug 152 mounted on end 142 of the cable 140.

Figure 5:
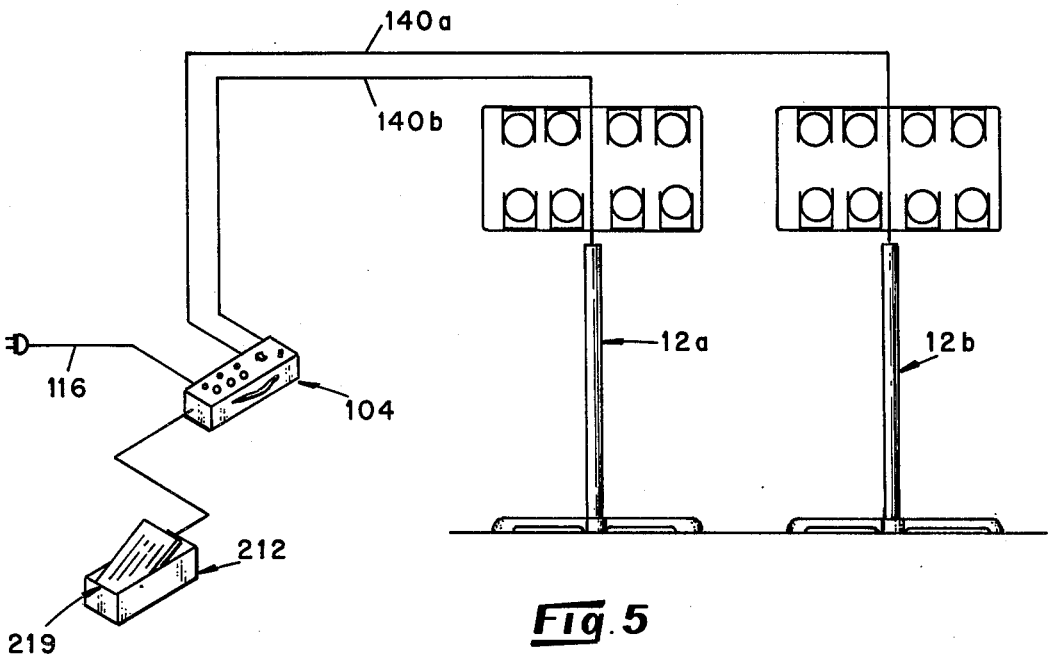
FIG. 5 is a perspective view of a system which includes two lighting trees connected through a suitable cable to the control box.

In the diagram depicted in FIG. 3, the circuitry 102 is adapted for controling two independent trees having eight lights, each, (See FIG. 5) with the lights arranged in pair groups. To this end, two cables **140*a* and 140*b* are connected to leads 114 and 112 through plugs 152*a* and 152*b* which are joined with the connectors 150*a* and 150*b* as shown in FIGS. 3 and 5. Since the lights in one embodiment are arranged in pair groups, two lights on each of the trees can be supplied through the return connector or lead 114 and one of the remaining connectors. For example, in certain applications it is desirable to have two lights of the same color comprising a pair group. Thus if lights 14 a–b on tree 12*a* are white, these lights can be fed through lead 114*a* and lead 112*a*. It will be recognized that lights of the same color will be wired in parallel on the tree 12*a* if they are simultaneously controlled. If lights 14 c–d on the same tree are blue, these lights can be wired through leads 114*a* and 112*b*. A further group pair can be wired through leads 114*a* and 112*c* and the final group pair can be wired through lead 114*a* and 112*d***.

Similarly, the lights on tree **12*b* will be fed through lead 114*b* and one of the leads 112** e–h.

It will be recognized by those skilled in the art that further connectors or jacks may be provided with the accompanying wiring to feed additional tree lights if desired. Moreover, if it is desired to have each of the lights on the tree controlled individually, both cables **140*a* and 140*b*** with the interconnected plugs and connectors may be connected to one tree.

Control switches generally indicated at 170 are interposed between the lead 112 connected to the supply and each of the leads 112 a–h which feed preselected lights or groups of lights carried by the tree. In this connection, the switches can be used to supply power to preselected lights or groups of lights to create desired stage lighting effects. More specifically, switch **170*a* selectively allows power to be fed to spot lihts, on one or both of the trees 12*a* and 12*b*. In the illustrated embodiment switches 170*b*, 170*c* and 170*d* selectively energize the various colored lights, or colored light groups. Each of the switches 170 a–d are mounted on the top panel 214 of the control box 104**. These switches are of conventional design and can be foot operated for purposes of leaving the operator's hand free as desired.

The control circuitry 100 includes a dimmer portion generally indicated at 176 which is interposed between the on-off switch 110 and the control switches **170*b*, 170*c* and 170*d*. Thus, the dimmer 176 serves to modulate the intensity of the lights which are switched on by control switches 170*b*, 170*c* and 170*d* but not those lights switched on by control switch 170*a*, which in the preferred embodiment controls the spot or white lights that are operated in either their "full intensity" or "off" mode. As necessary or desired, the spot light intensity could also be modulated by connecting lead 220 at terminal 222**.

Figure 4:
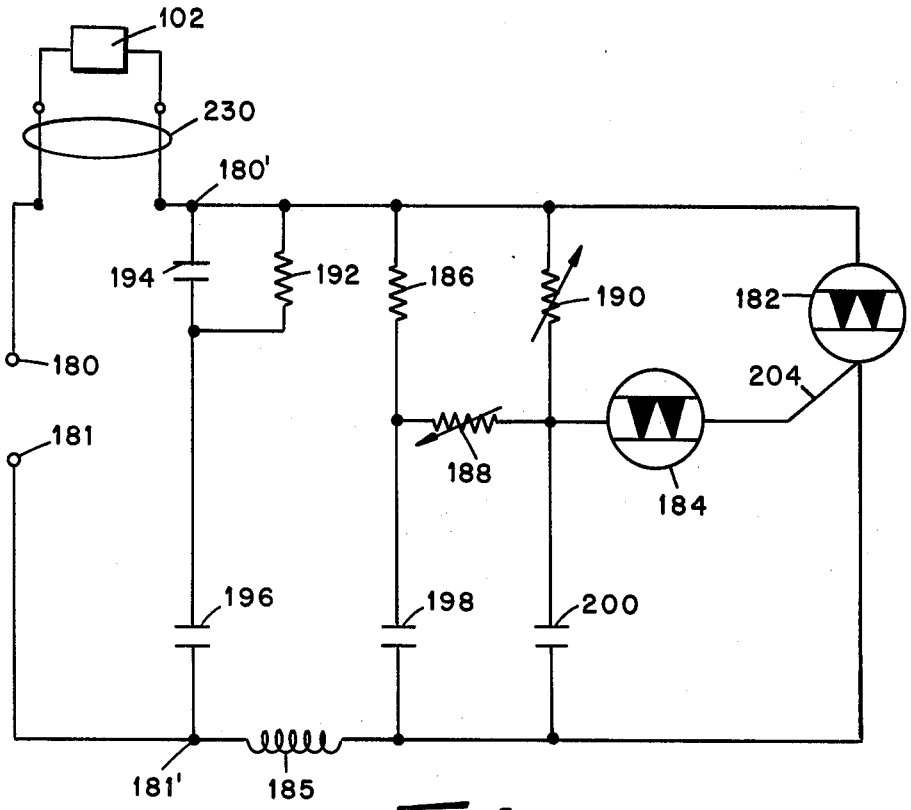
FIG. 4 is a schematic diagram of a dimmer circuit.

The circuitry of the dimmer 176 is illustrated in the schematic of FIG. 4. The portion of the circuitry 100 other than the dimmer is generally designated as 102. Upon closing any one of the switches 170 b–d, the circuitry 102 controlled by the dimmer can be approximately represented as a resistance of about eight ohms or less. Preferably a voltage of about 120 VAC at 60 HZ is provided from a standard outlet through the cord 116 to the terminals 180 and 181 connected to leads 114 and 112, respectively. At the beginning of any one cycle of the applied 60 HZ, 120 VAC power, triac 182 is in its high impedance "off" state. Therefore, the impedance across terminals 180' and 181' is the equivalent impedance of the resistors, capacitors and inductor 185 which at 60 HZ is greater than about 5000 ohms in magnitude for the element values set forth hereinafter. Thus, until the triac 182 fires to its "on" or low impedance state, the voltage across it is approximately equal to the voltage applied across terminals 180 and 181. The diac 184 is also in its "off" or high impedance state at the beginning of the voltage cycle.

As the applied voltage rises, the voltages across capicator 200, and consequently across diac 184, rise. The rate at which this voltage rises is determined by the network of resistors 186, 188, 190 and 192, the capicators 194, 196, 198 and 200 and the inductor 185. The circuit elements which have a major effect on the rate of the voltage rise across capicator 200 and diac 184 are the resistor or rheostat 190 and capicator 200. The rheostat 190 is foot operated, as will be described in greater detail hereinafter, and varying the resistance of the rheostat 190 varies the rate of change of the voltage across capacitor 200 and diac 184. When the voltage across the diac 184 reaches its breakdown voltage, it switches to its "on" state and its resistance becomes very small and the voltage across it drops to a low value, generally less than two volts. Then a current passes through rheostat 190 and diac 184 into the gate 204 of triac 182, triggering it into its "on" state. This in effect creates a very low resistance path for current through the triac 182, the inductor 185 and through the lights 14 fed through the circuitry 102. Thus, the resistance of the foot operated rheostat 190 as controlled by foot pedal 210, described hereinafter, controls the phase of the applied or line voltage at which current begins to flow through the lights 14. This effect averaged over many cycles of the line voltage determines the average intensity of the lights 14 and since the pulsing of power from the source (a conventional wall outlet, for example,) occurs at a rate of about 120 times per second, it is perceived by the human eye as a constant light intensity.

Rheostat 190 and resistor 188 together with capicator 198 comprise a network which serves to substantially set the phase at which the triac 182 fires when the rheostat 190 is at its maximum resistance when the operator's foot is removed from the pedal 210 and rheostat 190 is at its maximum value, the resistor 188, also a rheostat, can be adjusted to set the desired minimum light intensity.

Resistor 192, capicators 194 and 196 and inductor 185 comprise a network which serves to assist in reducing sudden disturbances of the line current when triac 182 is fired. To this end, current is drawn out of capicators 194 and 196 in the first few microseconds, for example, after the triac 100 switches on. Gradually, over the next millisecond (for the chosen circuit elements) the line provides more and more current, recharging capicators 194 and 196 and feeding the lights 14. The inductor 185 assists in smoothing the current transition by inhibiting sudden changes in the current through it.

Since all the circuit elements are bidirectional and symmetrical in the illustrated embodiment, the operation of the circuit for negative line voltage is the mirror image of its operation for positive line voltage, that is, all are negated and the firing phase is unchanged if the resistance of the rheostat 190 is unchanged.

The dimmer circuit 176 and its associated rheostat 190 in the illustrated embodiment is housed in foot pedal means 212 which is positioned on the supporting surface 16 and adapted for being actuated by the foot of a musician, for example, to vary the intensity of lights energized by operation of the switches 170*b*, 170*c* and/or 170*d*. As described more generally above, these switches 170 b–d are positioned on the panel 214 of the control box 106 such that the operator's foot can be used to turn on preselected lights, or groups of lights for purposes of creating a desired lighting effect. To this end, each of the switches 170 b–d, which are of conventional design, preferably include an actuator (shown in FIGS. 1 and 5) such that upon depression of the actuator of a preselected switch, the switch is closed, and the actuator is urged, as under the force of a spring, to its original position. Subsequent depression of the actuator opens the switch and a preselected group of lights is turned off (or an individual light may be turned off if the switch controls a single light). Switch 170*a* which controls the spot lights, is also mounted on the panel 214 and is operable by the operator's foot. It will be noted however, that the switch and operation of the dimmer does not modulate the intensity of the spot lights, in the illustrated embodiment. Alternatively, lead 220 of the spot light circuitry may be connected to terminal 222 such that the dimmer operation also varies the intensity of the spot lights when the switch 170*a* is closed and the resistance of the rheostat 190 is varied by operation of the foot pedal 210.

It will be recognized by those skilled in the art, that the dimmer 176 has a large equivalent impedance (about 5000 ohms for the circuit elements set forth below) relative to the lights (about 8 ohms for the circuit elements set forth below) until the triac 182 fires. Upon firing the triac 182 responsive to operation of the foot pedal 210, the power fed to the lights increases inasmuch as the impedance of the dimmer circuit 176 is reduced to a value which is approximately equal to or less than the impedance of the lights. Thus, the lights are energized. Moreover, the dimmer circuit 176 permits adjusting the low intensity level at which the lights are operated by varying the rheostat 188. Further, the illustrated dimmer includes elements as described in greater detail hereinabove which serve to reduce noise in surrounding systems which may result in the production of noise in electric musical instruments. Instrument noise commonly results where a rheostat alone controls the intensity modulation.

Figure 2:
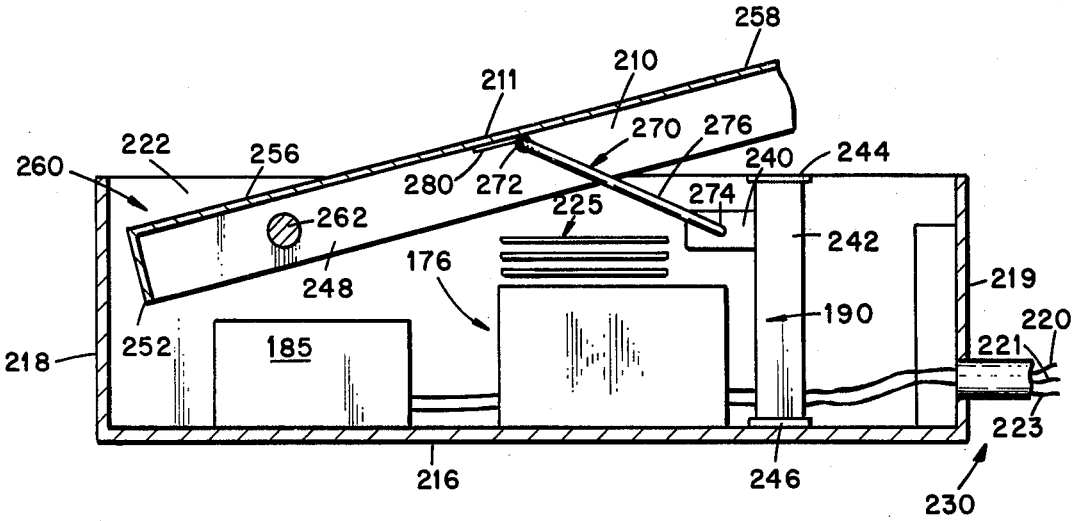
FIG. 2 is a sectional view of foot pedal means taken along line 2—2 of FIG. 1 which serves to vary the intensity of preselected lights or groups of lights carried by one or more of the trees.

The foot pedal means 212 comprises a substantially rectangular housing 214 in the illustrated embodiment which includes a base panel 216 and opposite upright end panels 218 and 219 which are joined at their opposite upright end edges by opposite side panels 222 and 224. Side panels 222 and 224 in the illustrated embodiment is provided with a plurality of elongated openings 225 which serve to assist in ventilating the interior portion of the housing 214 which carries the dimmer circuitry 176. The dimmer 176 is connected through cable 230, to the control box 104 (See FIGS. 2 and 3), which comprises leads 220, 221 and a ground 223, which is optional. The dimmer 176 is illustrated in block diagram form in FIG. 3 together with the inductor 185 and is shown mounted on the base panel 216 of the foot pedal housing.

Rheostat 190 is of conventional design and in the illustrated embodiment comprises an elongated body portion 242 which is secured at its opposite ends by brackets 244 and 246 to the side wall panel 222. This rheostat 190 includes a sliding arm 240 which varies the resistance across the rheostat and controls the intensity of preselected lights energized by the switches 170 b–d. In the illustrated embodiment, the arm 240 slides back and forth in a substantially vertical direction for varying the resistance at the rheostat output.

In the illustrated embodiment, the rheostat arm 240 is moved along the length of the rheostat 190 for purposes of varying the resistance by pivoting the foot pedal 210. More specifically, the foot pedal 210 comprises a substantially rectangular panel 211 which is intergally formed with depending side members 248 and 250 at its opposite side edges. These side members are joined at their opposite ends by opposed end members 252 and 254 which are intergally formed along their upper edges with the opposite end portions 256 and 258 of the foot pedal panel 211.

Pedal 210 is pivotally mounted on the housing 214 which defines an opening 260 proportioned for receiving the pedal 210 therein. In this connection, an elongated bolt 262 is received through registering openings provided in the housing side panels 222 and 224, and registering openings defined in the depending side members 248 and 250. This bolt 262 extends through the housing with the head of the bolt engaging the surface of panel 224 shown in FIG. 1. A nut is threadably received on the opposite end of the bolt 262 and engages the external surface of panel 222.

Pedal 210 can be pivoted about the bolt 262 for purposes of varying the resistance of the rheostat 190. To facilitate rotation of the pedal 210 or the bolt 262 a suitable grommet (not shown) may be interposed between the bolt 262 and the pedal side member 248 and 250 to reduce the friction therebetween. Moreover, suitable friction reduction washers may be interposed between the housing side panels 222 and 224 and the foot pedal side members 248 and 250, as necessary or desired to facilitate pivoting the foot pedal 210.

Linkage means are provided in order to mechanically connect the arm 240 of the rheostat 190 and the forward portion 258 of the foot pedal 210. To this end, a suitable elongated arm 270 is provided which is fabricated from a wire which is semi-rigid. This arm 270 includes opposite end portions 272 and 274 that extend substantially perpendicularly from the elongated portion 276 of the arm, and in opposite directions. End portion 272 of the arm is rotatably received in a bracket 280 secured as by welding to the underside of the foot pedal panel 211. Alternatively, screws can be used to secure the bracket to the pedal. The opposite end portion of the arm 270, which extends in the opposite direction from end portion 272, is rotatably received in an opening provided in the rheostat actuator arm 240.

In operation of the system, the foot of an operator is positioned on the topside of the foot pedal which is provided in one embodiment (see FIG. 1) with a mat 282 secured thereto as by glue to assist in preventing the operator's foot from slipping from the foot pedal. Upon pivoting the foot pedal 210, the lever arm 240 is moved to change the resistance of the rheostat 190 and thereby change the intensity of the lights or groups of lights closed by switches 170 b–d. The pedal can be pivoted by the foot of an operator to synchronize the light intensity modulation and rhythm of the music, if desired.

In one embodiment of the housing 214, a portion of the rearward corners and panel 218 of the substantially rectangular housing are removed as shown in FIG. 5 at 219. In this connection, an operator can position the heel of his foot on the end portion 256 of the pedal 210 and as this end portion of the pedal is pivoted downwardly, the operator's foot will not engage the housing. While the opening 260 is proportioned for receiving the heel portion of the operator's foot therein as the pedal 210 is rotated, removal of the rearward portion of the housing 214 as shown at 219 facilitates movement of the operator's foot.

In one embodiment of the dimmer 176 values were used as follows for various of the circuit components: capicator 194=0.47 microfarads; resistor 192=0.82 ohms; capicator 196=0.22 microfarads; resistor 186=92 ohms; capicator 198=0.1 microfarads; resistor (rheostat) 188=10,000 ohms; rheostat 190=250,000 ohms; capicator 200=0.2 microfarads; and inductor 185=100 microhenrys.

From the foregoing detailed description and drawings it will be recognized that a portable lighting system having certain advantages over the prior art has been depicted. The illustrated lighting system is adapted to be readily set up and dismanteled by a single musician, for example, who is not a skilled electrician. In this connection, a portable tree or trees are provided which carry a plurality of lights on a frame which is readily secured to or removed from the tree stand. The tree stand can be adjusted to vary the height of the lights as desired by adjusting the combined effective length of the collapsible stand. Certain of the lights of the system, particularly the white or spot lights can be operated in an "on" or "off" mode. Other lights such as colored lights or groups of colored lights can be selectively energized and a foot pedal which is foot operated can be used to modulate the intensity of the energized colored lights. The foot pedal and control box, which houses the various switches of the system can also be readily carried to a new site. Moreover, both the control box and foot pedal can be operated by a single foot of a musician for example while leaving the hands of the operator to play an instrument, if desired.

It is, of course, understood that although a preferred embodiment of the present invention had been illustrated and described, various modifications thereof will become apparent to those skilled in the art, and accordingly, the scope of the present invention should be defined only by the appended claims and equivalents thereof.

What is claimed is:

1. A portable lighting system adapted for being driven by a standard source comprising:

at least one lighting tree including a collapsible stand, a frame carried by said stand and a plurality of lights mounted on said frame, control means connected to said source and each of said lights, said control means including first switch means for selectively energizing at least one preselected light, and first means for controlling the intensity of at least one of said lights, said first means including a dimmer having a foot operated rheostat the intensity of at least one of said lights can be adjusted by an operator adjusting the resistance of said rheostat.

2. The lighting system of claim 1 wherein said stand includes a base engaging a supporting surface, a first upright member releaseably secured to said base, a second upright member carrying said frame and telescopically engaging said first member, whereby the combined effective length of said first and second member can be adjusted, means for selectively fixing said first and second members in a fixed relative position whereby said frame carrying said lights can be adjusted, vertically with respect to said supporting surface.

3. The lighting system of claim 1 including a switch for selectively supplying power to said first switch means.

4. The lighting system of claim 1 wherein said first switch means are mounted in a control box which is supported on a supporting surface, said first switch means including a plurality of switches each of said switches including a foot operable actuator for selectively opening and closing each of said plurality of switches.

5. The lighting system of claim 1 including a foot pedal means having a substantially rectangular housing, a foot pedal pivotally mounted on said housing, said rheostat being mounted within said housing, linkage means connecting said foot pedal and said dimmer pivotal movement of said foot pedal operates said dimmer and varies the resistance of said rheostat thereby varying the intensity of at least one of said lights.

6. The lighting system of claim 1 wherein said lights are multicolored.

7. The lighting system of claim 1 including bracket means rotatably mounted on said frame means, said bracket means rotatably carrying said lights the orientation of said lights can be adjusted.

8. The lighting system of claim 4 wherein said plurality of switches includes a second switch which selectively energizes at least one of said lights, and a third switch which selectively energizes at least another one of said lights, said third switch being connected to the light which it energizes through said dimmer said light controlled by said third switch can be intensity modulated by said dimmer.

9. The lighting system of claim 6 wherein said lights are arranged on said frame in multicolored groups, 10. The lighting system of claim 9 wherein said switch means includes group control switches, one of said group control switches being connected to one of said groups of multicolored lights for selectively energizing one of said groups of lights.

11. The lighting system of claim 4 including a housing carrying each of said group control switches.

12. Foot pedal means for varying the intensity of lights comprising:

a housing, a foot pedal pivotally mounted on said housing, a dimmer carried by said housing and invluding a rheostat having an adjustable arm for varying the resistance of said rheostat, means for connecting said dimmer to certain of said lights, linkage means comprising an elongated arm having a first end pivotally secured to said foot pedal and a further end being pivotally secured to said rheostat arm rotation of said foot pedal adjusts said rheostat arm and varies the resistance of said rheostat.

13. The foot pedal means of claim 1 wherein said rheostat includes an elongated body which is secured within said housing in a substantially upright position, said arm being disposed substantially perpendicularly with respect to said rheostat body and slidably in a substantially vertical direction for varying the resistance of said rheostat.

14. The foot pedal means of claim 1 wherein said housing is substantially rectangular and defines an opening which assists in providing ventilation of said dimmer carried by said housing.

15. The foot pedal means of claim 1 wherein said dimmer includes a triac which is fired by varying the resistance of said rheostat responsive to operation of said foot pedal.

* * * * *